US005538935A

United States Patent [19]

Hastreiter, Jr. et al.

[11] Patent Number: 5,538,935

[45] Date of Patent: Jul. 23, 1996

[54] RECEIVING ELEMENT CONTAINING ELASTOMERIC BEADS FOR THERMAL DYE TRANSFER

[75] Inventors: Jacob J. Hastreiter, Jr., Spencerport; Christine J. T. Landry, Fairport; William H. Simpson, Pittsford; John M. Noonan, Rochester; Paul E. Woodgate, Spencerport, all of N.Y.

[73] Assignee: Eastman Kodak Company, Rochester, N.Y.

[21] Appl. No.: 473,684

[22] Filed: Jun. 7, 1995

[51] Int. Cl.[6] ..... B41M 5/035; B41M 5/38

[52] U.S. Cl. ..... 503/227; 428/195; 428/206; 428/327; 428/913; 428/914

[58] Field of Search ..... 8/471; 428/195, 428/206, 327, 341, 913, 914; 503/227

[56] References Cited

FOREIGN PATENT DOCUMENTS 60-38192 2/1985 Japan .
6-286351 10/1994 Japan .

*Primary Examiner*—B. Hamilton Hess
*Attorney, Agent, or Firm*—Harold E. Cole

[57] ABSTRACT

A dye-receiving element comprising a support having thereon a dye image-receiving layer, the dye image-receiving element containing crosslinked elastomeric beads having a Tg of 45° C. or less, the elastomeric beads being made from an acrylic polymer, an acrylic copolymer or a styrenic copolymer, the elastomeric beads having from about 5 to about 40% by weight of a crosslinking agent, the beads having a particle size of from about 2 to about 20 μm.

18 Claims, No Drawings

RECEIVING ELEMENT CONTAINING ELASTOMERIC BEADS FOR THERMAL DYE TRANSFER

This invention relates to dye-receiving elements used in thermal dye transfer, and more particularly to a receiving element containing elastomeric beads.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support. The dye-receiving layer is usually overcoated with a second polymeric layer for protection against dye fade. However, such polymeric overcoats offer only minimal protection against retransfer of the dyes from the imaged receiving element to another support, for example, to a poly(vinyl chloride) (PVC) folder or sleeve which is commonly used to store an imaged receiver.

The images created by thermal dye transfer techniques have a propensity to degrade when stored in PVC folders or sleeves because the plasticizers contained in the latter will, on direct contact, react with the image dyes. The dyes become solubilized by the plasticizers and then diffuse out of the receiving layer into the PVC materials, so that distinct areas are observed where image dye has been removed.

JP 60/38192 discloses the incorporation of microparticles into a thermal recording receiving element for improved storage and abrasion resistance of the printed images. This Kokai teaches that the particles should have a glass transition temperature (Tg) above 80° C.

JP 6/286351 discloses a dye-receiving element containing "functional group modified silicone rubber elastic micron-sized particles" to prevent blocking or sticking to a dye-donor element during processing.

It is an object of this invention to provide a dye image-receiving element containing elastomeric particles which have improved printing efficiency, image quality and retransfer characteristics.

These and other objects are achieved in accordance with the invention, which comprises a dye-receiving element comprising a support having thereon a dye image-receiving layer, the dye image-receiving element containing crosslinked elastomeric beads having a Tg of 45° C. or less, the elastomeric beads being made from an acrylic polymer, an acrylic copolymer or a styrenic copolymer, the elastomeric beads having from about 5 to about 40% by weight of a crosslinking agent, the beads having a particle size of from about 2 to about 20 μm.

In contrast to prior art microbeads for dye-receivers which are harder and have a higher Tg, it has been found that the elastomeric microbeads of the invention which have a lower Tg are compressed under the weight of the thermal print head during printing, thereby allowing better contact between the dye-donor and dye-receiver elements. When microbeads having a high Tg are used, the microbeads are too rigid and prevent intimate contact between the dye-donor and dye-receiver during printing, resulting in image mottle and poor image quality. The improved dye-donor/dye-receiver contact achievable with the low Tg elastomeric microbeads of the invention results in reduced mottle and improved image quality. As noted above, the crosslinked elastomeric beads employed in the invention have a Tg of 45° C. or less, preferably 10° C. or less.

Another unexpected advantage when elastomeric microbeads according to the present invention are used is a reduction in the undesirable retransfer of dye from the printed image to an overlying PVC protective sleeve. It is believed that after compression by the thermal head during printing, the elastomeric microbeads of the invention will reassume their original shapes, thereby establishing a gap between the printed receiver element and overlying protective sleeve, thereby preventing dye retransfer. The inclusion of elastomeric particles into a dye-image receiving layer also provides for improved handling characteristics.

When inelastic, low Tg microbeads are used which are not partially crosslinked, they are crushed by the thermal head during printing and are unable to reassume their original shapes, so that no improvement regarding dye retransfer on storage in a PVC protective sleeve is observed.

Microbead elasticity is determined by the amount of crosslinking agent employed in making the microbead. If the amount of crosslinking agent used is too high, the microbeads produced will be too rigid and will not be deformed under the pressure exerted by the thermal print head during printing, which leads to mottle and poor image quality. If the amount of crosslinking agent in the microbeads is too low, the microbeads will not only be deformed under the pressure exerted by the thermal print head, but will also undergo nonelastic flow leading to permanent deformation, making recovery of their original shape impossible. Dye-receivers containing such particles will not prevent dye from leaching from the printed image to an overlying PVC protector sleeve.

Thus, the elastomeric microbeads used in the invention have a combination of both the proper Tg and level of crosslinking agent in order to achieve the desired degree of elasticity.

The elastomeric microbeads of the invention may be incorporated in either the dye image-receiving layer or in an overcoat layer thereon. In a preferred embodiment of the invention, the elastomeric microbeads are present in an overcoat layer. The elastomeric microbeads may be employed in any amount effective for the intended purpose. In general, good results have been obtained at a coverage of from about 0.06 to about 0.2 g/m$^2$. As noted above, the elastomeric microbeads generally have a particle size of from about 2 μm to about 20 μm. If the elastomeric microbeads have a particle size of less than about 2 μm, they are ineffective in providing retransfer resistance, as will be shown hereinafter.

As described above the elastomeric beads used in the invention are made from an acrylic polymer or copolymer, such as butyl-, ethyl-, propyl-, hexyl-, 2-ethyl hexyl-, 2-chloroethyl-, 4-chlorobutyl- or 2 -ethoxyethyl- acrylate or methacrylate; acrylic acid; methacrylic acid, hydroxyethyl acrylate, etc.; or a styrenic copolymer, such as styrene-butadiene, styrene-acrylonitrile-butadiene, styrene-isoprene, hydrogenated styrene-butadiene, etc., or mixtures thereof.

The elastomeric beads may be crosslinked with various crosslinking agents, which may also be part of the elastomeric copolymer, such as divinylbenzene; ethylene glycol diacrylate; 1,4-cyclohexylene-bis(oxyethyl) dimethacrylate; 1,4-cyclohexylene-bis(oxypropyl) diacrylate; 1,4-cyclohexylene-bis(oxypropyl) dimethacrylate; ethylene glycol diacrylate; etc.

The glass transition temperatures referred to below were determined by the method of differential scanning calorimetry (DSC) at a scanning rate of 20° C./minute and the onset in the change in heat capacity was taken as the Tg.

Following are examples of typical elastomeric microbeads which may be employed in the invention:

Bead 1) EXL5137 acrylic terpolymer microbeads (Rohm & Haas Co.) having a nominal diameter of approximately 6 to 8 μm and a Tg of approximately −33° C.

Bead 2) poly(butyl acrylate-co-divinylbenzene) (80:20 mole ratio) having a nominal diameter of approximately 4 μm and a Tg of approximately −31° C.

Bead 3) poly(styrene-co-butyl acrylate-co-divinylbenzene) (40:40:20 mole ratio) having a nominal diameter of approximately 4 μm and a Tg of approximately 45° C.

Bead 4) poly(ethyl acrylate-co-ethylene glycol diacrylate) (90:10 mole ratio) having a nominal diameter of approximately 5 μm and a Tg of approximately −22° C.

Bead 5) poly(2-ethylhexyl acrylate-co-styrene-co-divinylbenzene)(45:40:15 mole ratio) having a nominal diameter of approximately 5 μm and a Tg of approximately 20° C.

Bead 6) poly[2-chloroethylacrylate-co-1,4 -cyclohexylene-bis(oxypropyl) diacrylate] (80:20 mole ratio) having a nominal diameter of approximately 7 μm and a Tg of approximately −10° C.

Bead 7) poly(butyl methacrylate-co-hydroxyethyl-acrylate-co-divinylbenzene)(65:10:25 mole ratio) having a nominal diameter of approximately 6 μm and a Tg of approximately 29° C.

Bead 8) poly(styrene-co-butadiene-co-divinylbenzene)(40:50:10 mole ratio) having a nominal diameter of approximately 8 μm and a Tg of approximately −55° C.

Bead 9) poly(styrene-co-2-ethyoxyethyl acrylate-co-ethylene glycol diacrylate)(20:45:35 mole ratio) having a nominal diameter of approximately 4 μm and a Tg of approximately −5° C.

Bead 10) poly(styrene-co-hexyl acrylate-co-divinylbenzene)(10:70:20 mole ratio) having a nominal diameter of approximately 4 μm and a Tg of approximately −15° C.

The dye image-receiving layer of the receiving elements of the invention may comprise, for example, a polycarbonate, a polyurethane, a polyester, polyacrylate, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657 of Harrison et al., the disclosure of which is incorporated by reference.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Dye-donor elements that are used with the dye-receiving element of the invention conventionally comprise a support having thereon a dye layer comprising a dye dispersed in a binder. Any dye can be used in the dye-donor employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used such as lasers.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1—BEAD PREPARATION

A limited coalescence process was used to prepare microbeads containing the appropriate monomers. A monomer phase with a free radical initiator was mixed with an aqueous phase containing poly(methylaminoethanol adipate) and colloidal silica. The resulting dispersion was passed through a Gaulin Homogenizer to give monomer droplets of a certain size suspended in the aqueous phase. The mixture was then heated at 55° C. for sixteen hours. The microbeads were collected, washed with water and dried.

The procedure for making Bead 3) or poly(styrene-co-butyl acrylate-co-divinylbenzene) (40:40:20) microbeads was as follows:

A monomer mixture of 200 g styrene, 200 g butyl acrylate, 100 g divinylbenzene, and 5 g Vazo 52 (an azo-initiator from DuPont) was combined with a mixture of 6.3 g poly(methylaminoethanol adipate), and 135 g Nalcoag 1060 dispersing agent (Nalco Co.) in 4 L water. The mixture was stirred rapidly with a laboratory stirrer to obtain a crude emulsion. The crude emulsion was then passed through a Gaulin Homogenizer to obtain 4 μm monomer droplets in water. The resulting suspension was heated at 55° C. overnight in a 5 L flask to polymerize the monomer droplets. The mixture was cooled and the polymer beads were isolated by filtration. The beads were washed with water and then dried in a vacuum oven.

The procedure for making Bead 2) or poly(butyl acrylate-co-divinylbenzene) (80:20) microbeads was similar to the above procedure, except that styrene was omitted and the amount of butyl acrylate used was 400 g.

EXAMPLE 2—Print Quality-Reflection Prints

Control 1: A receiver element was prepared by coating a 38 μm thick microvoided composite film (OPPalyte 350TW™, Mobil Chemical Co.) as disclosed in U.S. Pat. No. 5,244,861, with a dye-receiving layer comprising Makrolone™ KL3-1013 (a hisphenol A polycarbonate random copolymer from Bayer AG) (1.78 g/m$^2$), Lexane™ 141–112, a bisphenol A polycarbonate (General Electric Co.), (1.44 g/m$^2$), dibutyl phthalate (0.32 g/m$^2$), diphenyl phthalate (0.32 g/m$^2$), Fluorade™ FC-431, a perfluoroamido surfactant (3M Corp.) (0.012 g/m$^2$) from a dichloroethane and trichloroethylene solvent mixture. This receiver layer was overcoated with a polymeric layer consisting of Kodak polycarbonate, shown below, (0.215 g/m$^2$), Fluorad™ FC-431 (0.016 g/m$^2$) and DC-510, a silicone fluid surfactant (Dow Corning Corp.) (0.009 g/m$^2$) dissolved in a dichloromethane and trichloroethylene solvent mixture.

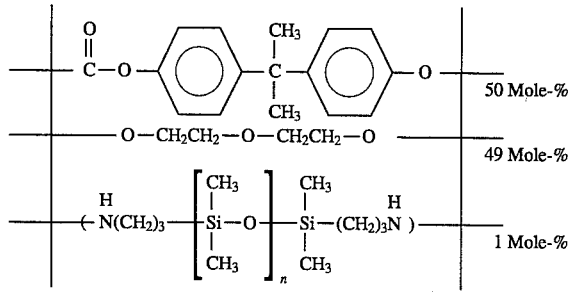

where n is ~55–65

A linear condensation polymer considered to be derived from carbonic acid, bisphenol A, diethylene glycol, and aminopropyl-terminated polydimethylsiloxane.

Control 2: A transparent poly(ethylene terephthalate) support was coated with 1) a subbing layer of poly(acrylonitrile-co-vinylidene chloride-co-acrylic acid) (14:79:7 wt. ratio) (0.08 g/m$^2$) from butanone solvent, and 2) a dye image-receiving layer as described in Control 1.

Control 3—Reflection Print with Deformable Beads:

This is the same as Control 1 but with the incorporation of Control Bead "A", nonelastic, deformable microbeads composed of 98% styrene, 1% butyl acrylate and 1% divinylbenzene (0.108 g/m$^2$), having a nominal diameter of approximately 4 μm, into the polymeric overcoat layer.

Control 4—Reflection Print with Hard Beads:

This is the same as Control 1 but with the incorporation of Control Bead "B", nonelastic, hard microbeads composed of divinylbenzene (0.108 g/m$^2$), having a nominal diameter of approximately 10.7 μm, into the polymeric overcoat layer.

Control 5—Reflection Print with Submicron Beads

This is the same as Control 1 but with the incorporation of Control Bead "C", EXL3691 beads of a methyacrylate-butadiene-styrene copolymer core with a poly(methyl methacrylate) shell (Rohm and Haas Co.) (0.108 g/m$^2$) having a nominal diameter of approximately 0.15 μm.

Control 6—Reflection Print with Submicron Beads

This is the same as Control 1 but with the incorporation of Control Bead "D", EXL3330 beads of a methyacrylate-butadiene-styrene copolymer core with a poly(methyl methacrylate) shell (Rohm and Haas Co.) (0.108 g/m$^2$) having a nominal diameter of approximately 0.6μm.

E-1: This is the same as Control 1 but with the incorporation of Bead 1 (0.108 g/m$^2$) into the polymeric overcoat layer.

E-2: This is the same as Control 1 but with the incorporation of Bead 2 (0.108 g/m$^2$) into the polymeric overcoat layer.

E-3: This is the same as Control 1 but with the incorporation of Bead 3 (0.108 g/m$^2$) into the polymeric overcoat layer.

E-4: This is the same as Control 2 but with the incorporation of Bead 1 (0.108 g/m$^2$) into the polymeric overcoat layer.

E-5: This is the same as Control 2 but with the incorporation of Bead 2 (0.108 g/m$^2$) into the polymeric overcoat layer.

E-6: This is the same as Control 2 but with the incorporation of Bead 3 (0.108 g/m$^2$) into the polymeric overcoat layer.

A dye donor element of sequential areas of cyan, magenta and yellow dye was prepared as described in U.S. Pat. No. 5,262,378, column 6, line 42 through column 7, line 68.

Eleven-step sensitometric thermal dye transfer images and a uniform density patch were prepared from the above dye-donor and dye-receiver elements. The dye side of the dye-donor element approximately 10 cm×15 cm in area was placed in contact with the dye image-receiving layer side of a dye-receiving element of the same area. This assemblage was clamped to a stepper motor-driven, 60 mm diameter rubber roller. A thermal head (TDK No. 8I0625, thermostatted at 31° C.) was pressed with a force of 24.4 newton (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 mμs/pulse) at 129 mμs intervals during a 16.9 mμs/dot printing cycle. A stepped image density was generated by incrementally increasing the number of pulses/dot from a minimum of 0 to a maximum of 127 pulses/dot. The voltage supplied to the thermal head was approximately 10.25 v resulting in an instantaneous peak power of 0.214 watts/dot and a maximum total energy of 3.48 mJ/dot.

After printing, the dye-donor element was separated from the imaged receiving element and the reflection print sample was visually examined and evaluated for image quality as compared to Control 1 which did not contain any microbeads. Using an X-Rite densitometer (X-Rite Inc., Grandville, Mich.), red, green and blue Status A reflection density measurements of the step wedge gradients for each of the imaged receiver samples were determined and rated in comparison to the amount of density obtained using Control 1.

A "1" rating indicates no difference from Control 1 and a "2" rating indicates that there was a significant change as compared to Control 1, rendering the print unusable. The following results were obtained:

TABLE 1

| RECEIVER ELEMENT | MICROBEAD Tg (°C.) | PRINTING EFFICIENCY | IMAGE QUALITY |
|---|---|---|---|
| Control 1 | — | 1 | 1 |
| Control 3 | 90 | 1 | 1 |
| Control 4 | >180 | 2 | 2 |
| Control 5 | −76 | 1 | 1 |
| Control 6 | −33 | 1 | 1 |
| E-1 | −33 | 1 | 1 |
| E-2 | −31 | 1 | 1 |
| E-3 | 45 | 1 | 1 |

The above results show that when nonelastic, hard microbeads having a high Tg (Control 4) are incorporated into a dye-receiving element, the degree of image mottle is high, resulting in poor image quality, along with a reduced transfer efficiency, as compared to the elements containing the elastomeric microbeads having a low Tg which are used in accordance with the invention. The above results also show that there is no adverse effect in using the microbeads in accordance with the invention as compared to Control 1 which contained no microbeads.

Although Control 3 which contained nonelastic, deformable microbeads and Controls 5–6 which contained microbeads having a particle size of less than 2 μm did not show any adverse effects as compared to Control 1, they had other problems as shown in Example 3 below.

EXAMPLE 3—Transfer to PVC from Reflection Prints

A second set of reflection images was printed as described in Example 2. Following printing, each of the imaged receiver samples was covered with a sheet of plasticized PVC. The imaged, PVC-covered samples were then stacked and placed into a polyethylene-lined foil envelope and incubated for 7 days at 50° C. and 50% RH. The envelope containing the samples was left unsealed to allow for humidity equilibration between the stacked samples and the incubation chamber.

A one kilogram weight was placed on top of the stacked receiver at the start of the incubation and removed only at the conclusion when the sample was removed from the incubation chamber. Following incubation, the PVC sheet was removed from each of the imaged receivers.

The arithmetic mean from a series of red, green and blue Status A transmission density measurements of the PVC corresponding to the location of the uniform density patch, using an X-Rite densitometer, was used to determine the quantity of dye which had diffused into the PVC. Density measurements of the PVC were taken before and after incubation. The corresponding transmission densities for the PVC used in the tests and prior to incubation were 0.02, 0.01 and 0.01 for red, green and blue, respectively. The following results were obtained:

TABLE 2

| RECEIVER | RED DENSITY | GREEN DENSITY | BLUE DENSITY |
|---|---|---|---|
| Control 1 | 0.20 | 0.17 | 0.15 |
| Control 3 | 0.24 | 0.22 | 0.19 |
| Control 5 | 0.17 | 0.15 | 0.12 |
| Control 6 | 0.22 | 0.19 | 0.16 |
| E-1 | 0.02 | 0.02 | 0.01 |
| E-2 | 0.04 | 0.04 | 0.03 |
| E-3 | 0.03 | 0.02 | 0.02 |

The above data illustrate that using microbeads in accordance with the invention reduces the amount of dye retransferred from a reflection print to PVC, as compared to Control 1 which had no microbeads, Control 3 which had deformable microbeads having a Tg of 90° C., and Controls 5 and 6 which had microbeads having a particle size of less than 2 μm.

EXAMPLE 4—Print Quality-Transparencies

Transparent receiver materials as listed below were imaged as described in Example 2. The thermally-transferred image consisted of a uniform density patch with an area of approximately 10 $cm^2$ as well as a step wedge gradient.

The transparent print samples were placed on a Model 920 Overhead Projector (3M Corp.) and the projected images were examined and evaluated for image quality as compared to Control 2 which did not contain any microbeads. Using an X-Rite densitometer, red, green and blue Status A transmission density measurements of the step wedge gradients for each of the imaged transparency receiver samples were determined and rated in comparison to the amount of density obtained using Control 2.

A "1" rating indicates no difference from Control 2 and a "2" rating indicates that there was a significant change as compared to Control 2, rendering the print unusable. The following results were obtained:

TABLE 3

| RECEIVER ELEMENT | PRINTING EFFICIENCY | IMAGE QUALITY |
|---|---|---|
| Control 2 | 1 | 1 |
| E-4 | 1 | 1 |
| E-5 | 1 | 1 |
| E-6 | 1 | 1 |

The above results indicate that there is no adverse effect in using microbeads in accordance with the invention as compared to Control 2 which contained no microbeads.

EXAMPLE 5—Transfer to PVC From Transparencies

A second set of transparent images was printed as described in Example 3. The following results were obtained:

TABLE 4

| RECEIVER | RED DENSITY | GREEN DENSITY | BLUE DENSITY |
|---|---|---|---|
| Control 2 | 0.39 | 0.40 | 0.32 |
| E-4 | 0.03 | 0.03 | 0.03 |
| E-5 | 0.06 | 0.06 | 0.06 |
| E-6 | 0.03 | 0.03 | 0.03 |

The above data illustrate that using microbeads in accordance with the invention reduces the amount of dye retransferred from a transparency to PVC, as compared to Control 2 which contained no microbeads.

The invention has been described in detail with particular reference to preferred embodiments thereof, but it will be understood that variations and modifications can be effected within the spirit and scope of the invention.

What is claimed is:

1. A dye-receiving element comprising a support having thereon a dye image-receiving layer, said dye image-receiving element containing crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of from about 2 to about 20 μm.

2. The element of claim 1 wherein said elastomeric beads have a Tg of 10° C. or less.

3. The element of claim 1 wherein said elastomeric beads are made of poly(butyl acrylate-co-divinylbenzene).

4. The element of claim 1 wherein said elastomeric beads are made of poly(styrene-co-butyl acrylate-co-divinylbenzene).

5. The element of claim 1 wherein said elastomeric beads are present at a coverage of from about 0.06 to about 0.2 $g/m^2$.

6. The element of claim 1 wherein said elastomeric beads are present in a separate layer over said dye image-receiving layer.

7. A process of forming a dye transfer image comprising:

a) imagewise-heating a dye-donor element comprising a support having thereon a dye layer comprising a dye dispersed in a binder, and b) transferring a dye image to a dye-receiving element comprising a support having thereon a dye image-receiving layer to form said dye transfer image, wherein said dye image-receiving element contains crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of from about 2 to about 20 μm.

8. The process of claim 7 wherein said elastomeric beads have a Tg of 10° C. or less.

9. The process of claim 7 wherein said elastomeric beads are made of poly(butyl acrylate-co-divinylbenzene).

10. The process of claim 7 wherein said elastomeric beads are made of poly(styrene-co-butyl acrylate-co-divinylbenzene).

11. The process of claim 7 wherein said elastomeric beads are present at a coverage of from about 0.06 to about 0.2 $g/m^2$.

12. The process of claim 7 wherein said elastomeric beads are present in a separate layer over said dye image-receiving layer.

13. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein said dye image-receiving element contains crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of from about 2 to about 20 μm.

14. The assemblage of claim 13 wherein said elastomeric beads have a Tg of 10° C. or less.

15. The assemblage of claim 13 wherein said elastomeric beads are made of poly(butyl acrylate-co-divinylbenzene).

16. The assemblage of claim 13 wherein said elastomeric beads are made of poly(styrene-co-butyl acrylate-co-divinylbenzene).

17. The assemblage of claim 13 wherein said elastomeric beads are present at a coverage of from about 0.06 to about 0.2 $g/m^2$.

18. The assemblage of claim 13 wherein elastomeric beads are present in a separate layer over said dye image-receiving layer.

* * * * *